US005207067A

United States Patent [19]

Acharya

[11] Patent Number: 5,207,067

[45] Date of Patent: May 4, 1993

[54] AIR SEPARATION

[75] Inventor: Divyanshu R. Acharya, Chiddingfold, England

[73] Assignee: The BOC Group plc, Windlesham, England

[21] Appl. No.: 819,045

[22] Filed: Jan. 10, 1992

[30] Foreign Application Priority Data

Jan. 15, 1991 [GB] United Kingdom ..... 9100814

[51] Int. Cl.[5] ..... F25J 3/02

[52] U.S. Cl. ..... 62/24; 62/39

[58] Field of Search ..... 62/38, 39, 40, 24

[56] References Cited

U.S. PATENT DOCUMENTS 4,867,773 9/1989 Thorogood et al. ..... 62/39

4,927,441 5/1990 Agrawal ..... 62/39

*Primary Examiner*—Ronald C. Capossela

*Attorney, Agent, or Firm*—David M. Rosenblum; Larry R. Cassett

[57] ABSTRACT

Air is compressed in a first compressor and has carbon dioxide and water vapor removed therefrom in a purification apparatus. The air is then cooled by passage through main heat exchangers and to a temperature suitable for its separation by rectification. The cooled air is separated in a single rectification column. Liquid oxygen is withdrawn from the column by a pump and is passed through the heat exchangers and countercurrently to the air stream and is thereby vaporized, a high pressure gaseous oxygen product thus being formed. Nitrogen vapor is withdrawn from the top of the column through an outlet is warmed by passage through a further heat exchanger and the heat exchanger. The nitrogen is then divided. One part is further warmed in the heat exchanger, is compressed in a compressor, and is returned through the head exchangers as a heat exchange stream countercurrently to the oxygen product stream. The other part of the nitrogen is expanded in a turbine with the performance of external work and is employed to provide cooling for the heat exchanger. The heat exchanger is used to sub-cool a liquid nitrogen stream which is introduced into the column through an inlet as reflux for the column. The compressor operates at a relatively low pressure enabling plate-fin heat exchangers to be employed.

7 Claims, 4 Drawing Sheets

AIR SEPARATION

BACKGROUND OF THE INVENTION

This invention relates to air separation. In particular, it relates to an air separation process and apparatus in which a liquid oxygen stream is withdrawn from a rectification column, is pressurized, and is then vaporized to form a high pressure, gaseous oxygen, product stream. Such processes are often referred to as 'liquid pumping' processes.

Such a process may, for example, be used to provide high pressure oxygen for the manufacture of synthetic fuel gases or for the gasification of coal. By using a pump to pressurize liquid oxygen withdrawn from the rectification column, the use of an oxygen compressor is avoided. Since oxygen compressors are expensive and can be hazardous to operate, it is particularly desirable to avoid their use, and for this reason oxygen production processes using a liquid pump to withdraw oxygen in the liquid state from a rectification column find particular favor in commercial practice. Nonetheless, such processes involving the use of liquid oxygen pumping do have certain drawbacks. Suppose, for example, the oxygen product is required at a pressure of 50 atmospheres absolute (5 MPa). In order to effect varorization of the liquid oxygen it is normal to pass it through a heat exchanger countercurrently to a stream of fluid taken from the incoming air or the nitrogen product of the process. It is desirable to maintain the specific enthalpy-temperature profile of the heat exchange stream in close conformity with that of the liquid oxygen stream being vaporized. As the temperature of the liquid oxygen stream rises, so its specific enthalpy increases. The rate of change in the change in specific enthalpy with temperature becomes progressively greater until a first maximum is reached. The specific enthalpy then increases sharply with temperature until a second maximum rate of change in the change of specific enthalpy with temperature is reached. The rate of change of specific enthalpy of the oxygen with temperature then becomes less marked. When the oxygen is at a pressure below its critical pressure, the two maxima occur at the same temperature and represent the start and finish of varorization of the oxygen. When the oxygen is above its critical pressure, the two maxima occur at two different temperatures. The heat exchange stream also has a specific enthalpy-temperature profile with two maxima. In order best to "fit" the specific enthalpy-temperature profile of the oxygen stream being warmed with that of the heat exchange stream being cooled, the first or lower temperature maximum of the heat exchange stream should be at a temperature a few degrees K below that of the oxygen stream being warmed. This consideration imposes a requirement that the pressure of the heat exchange stream should be more than twice that of the pressure to which the liquid oxygen stream is raised. Accordingly, when the oxygen stream is required at a pressure of 50 atmospheres absolute (5 MPa), the heat exchange stream, if it is air or nitrogen, needs to be at a pressure of more than 100 atmospheres absolute. Conventional plate-fin heat exchangers cannot safely withstand such high pressures. Accordingly, the heat exchange between the liquid oxygen stream and the heat exchange stream is performed in a separate heat exchanger in parallel with a plate-fin heat exchanger used to cool a major portion of the incoming air to a temperature suitable for its separation by rectification.

The parallel heat exchanger is typically of the "spiral-wound" kind. Such heat exchangers are able to withstand very high operating pressures, but are relatively expensive to fabricate. Moreover, to produce pressures in excess of 100 atmospheres absolute (10 MPa) it is generally necessary to use reciprocating rather than rotary compressors. Such reciprocating compressors are expensive, inefficient and prone to failure.

GB-A-2 079 428 and GB-A-2 080 929 disclose complex liquid pumping processes which avoid the use of such high pressures in the heat exchange streams but which nonetheless use an arrangement of two parallel heat exchangers each having a warm end operating at or close to ambient temperature and a cold end operating at cryogenic temperatures.

SUMMARY OF THIS INVENTION

It is accordingly an aim of the present invention to provide a method and apparatus for separating air in which a stream of liquid oxygen is withdrawn from a rectification column used to separate the air, and the stream is pressurized by operation of a pump and is then vaporized by countercurrent heat exchange with a stream comprising nitrogen, wherein the pressure of the heat exchange stream is able to be kept well below a value of twice the pressure to which the liquid oxygen stream is raised, said value typically not being greater than 100 atmospheres (10 MPa) and wherein there is no requirement for a complex arrangement of two or more parallel heat exchangers each having a warm end operating at about ambient temperature and a cold end operating at cryogenic temperatures.

According to the present invention there is provided a method of separating air, including the steps of cooling by heat exchange a stream of compressed air to reduce its temperature to a level suitable for its separation by rectification, separating the air by rectification into oxygen and nitrogen fractions, taking a stream of liquid oxygen from the oxygen fraction and a stream of nitrogen vapor from the nitrogen fraction, warming the nitrogen stream in countercurrent heat exchange with the air stream being cooled, pressurizing the liquid oxygen stream, and raising its temperature by countercurrent heat exchange with a heat exchange stream and the air stream being cooled, and taking a part of the nitrogen stream, expanding it with the performance of external work and countercurrently heat exchanging it with air passing to a rectification column comprising a single stage in which said rectification is performed, wherein said heat exchange stream is formed by taking another part of the nitrogen stream and further compressing it, and the work-expanded nitrogen stream is used to provide cooling for a heat exchanger in which a liquid nitrogen stream is sub-cooled by heat exchange with said stream of compressed air upstream of being introduced into the rectification column as reflux.

Preferably, the relative pressures to which said liquid oxygen and heat exchange streams are raised are preferably such that the lower temperature maximum on the specific enthalpy-temperature curve of the heat exchange stream is at a temperature not greater than that of the lower temperature maximum on the specific enthalpy-temperature curve of the liquid oxygen stream. Preferably, neither the heat exchange nor the said liquid oxygen stream is raised in pressure to over 100 atmospheres absolute (10 MPa).

The method according to the invention makes it possible to conduct the heat exchange of first the compressed air stream with the nitrogen stream and the liquid oxygen stream with the said heat exchange stream in the same heat exchanger or series of heat exchangers when for example producing a gaseous oxygen product at a pressure of 50 atmospheres absolute.

The invention also provides apparatus for separating air, comprising a first compressor for compressing an air stream; a main heat exchanger or series of main heat exchangers for reducing the temperature of the compressed air stream to a temperature suitable for its separation by rectification; a rectification column comprising a single stage for separating the air into oxygen and nitrogen fractions having an inlet for the temperature-reduced air stream; a first outlet from the rectification column for a liquid oxygen stream; a pump having an inlet in communication with said first outlet and an outlet in communication with the cold end of said main heat exchanger or series of main heat exchangers whereby, in operation, the oxygen stream is able to flow in countercurrent heat exchange with the air stream; a second outlet from the rectification column for a stream of nitrogen vapor communicating with the cold end of the main heat exchanger or series of main heat exchangers; an expansion turbine for taking a part of the nitrogen stream and expanding it with the performance of external work, said turbine having an outlet in communication with the cold end of the main heat exchanger or series of main heat exchangers, whereby, in operation, the expanded part of the nitrogen stream is able to flow in countercurrent heat exchange with the compressed air stream; a second compressor for taking another part of the nitrogen stream and passing it through the main heat exchanger or series of main heat exchangers as a heat exchange stream countercurrently to the oxygen stream, and a further heat exchanger for subcooling a liquid nitrogen stream upstream of introduction of the liquid nitrogen stream into the rectification column as reflux; said further heat exchanger being arranged in use, for the passage therethrough of said expanded part of the nitrogen stream upstream of its countercurrent heat exchange with the compressed air stream.

The main heat exchanger or members of the series of main heat exchangers are preferably each plate-fin heat exchangers.

Preferably, the heat exchange stream leaves the cold end of the main heat exchanger or series of main heat exchangers with a specific enthalpy and at a temperature that lie below the lower temperature maximum on the specific enthalpy-temperature curve of the stream. The heat exchange stream may leave the cold end of the main heat exchanger or series of main heat exchangers at a pressure below its critical pressure, and hence be a liquid, or at a pressure above the critical pressure (such that it has no discrete liquid phase), depending on the pressure at which the oxygen product is required from the warm end of the main heat exchanger or series of main heat exchangers.

The use of the work expanded nitrogen stream (in addition to nitrogen from the column) facilitates reduction of the enthalpy of the streams entering the column, thus enabling the oxygen product to be withdrawn as a liquid.

Reflux and reboil for the column are preferably provided by a heat pump cycle in which nitrogen is withdrawn from the top of the rectification column, is warmed by passage from the cold end to the warm end of the main heat exchanger or series of main heat exchangers, is compressed, is returned through the main heat exchanger or series of main heat exchangers from the warm end to the cold end thereof as the heat exchange stream, is employed to reboil liquid oxygen at the bottom of the rectification column, is subjected to said sub-cooling, is passed through a valve to reduce its pressure, and is introduced into the upper region of the rectification column as liquid nitrogen reflux. A part of the stream passing from the cold end to the warm end of the main heat exchanger or series of main heat exchangers is preferably withdrawn therefrom, expanded in a turbine with the performance of external work, employed to sub-cool the liquid nitrogen stream, and passed through the main heat exchanger or series of main heat exchangers from the cold end to the warm end thereof. The proportion of the nitrogen stream which is so withdrawn may be sufficient for the expanded nitrogen to meet all the refrigeration requirements of the process. Alternatively, a part of the incoming air stream may be withdrawn therefrom upstream of the warm end of the main heat exchanger or series of main heat exchangers, further compressed in another compressor passed through the main heat exchanger or series of main heat exchangers, as another heat exchange stream, and then expanded in a turbine and introduced into the rectification column as a liquid.

The method and apparatus according to the invention are particularly suited to use in producing an oxygen product containing about 95% by volume of oxygen at a pressure of about 50 atmospheres absolute.

BRIEF DESCRIPTION OF THE DRAWINGS

The method and apparatus according to the invention will now be described by way of example with reference to the accompanying drawings, in which.

DETAILED DESCRIPTION

Figure 1:
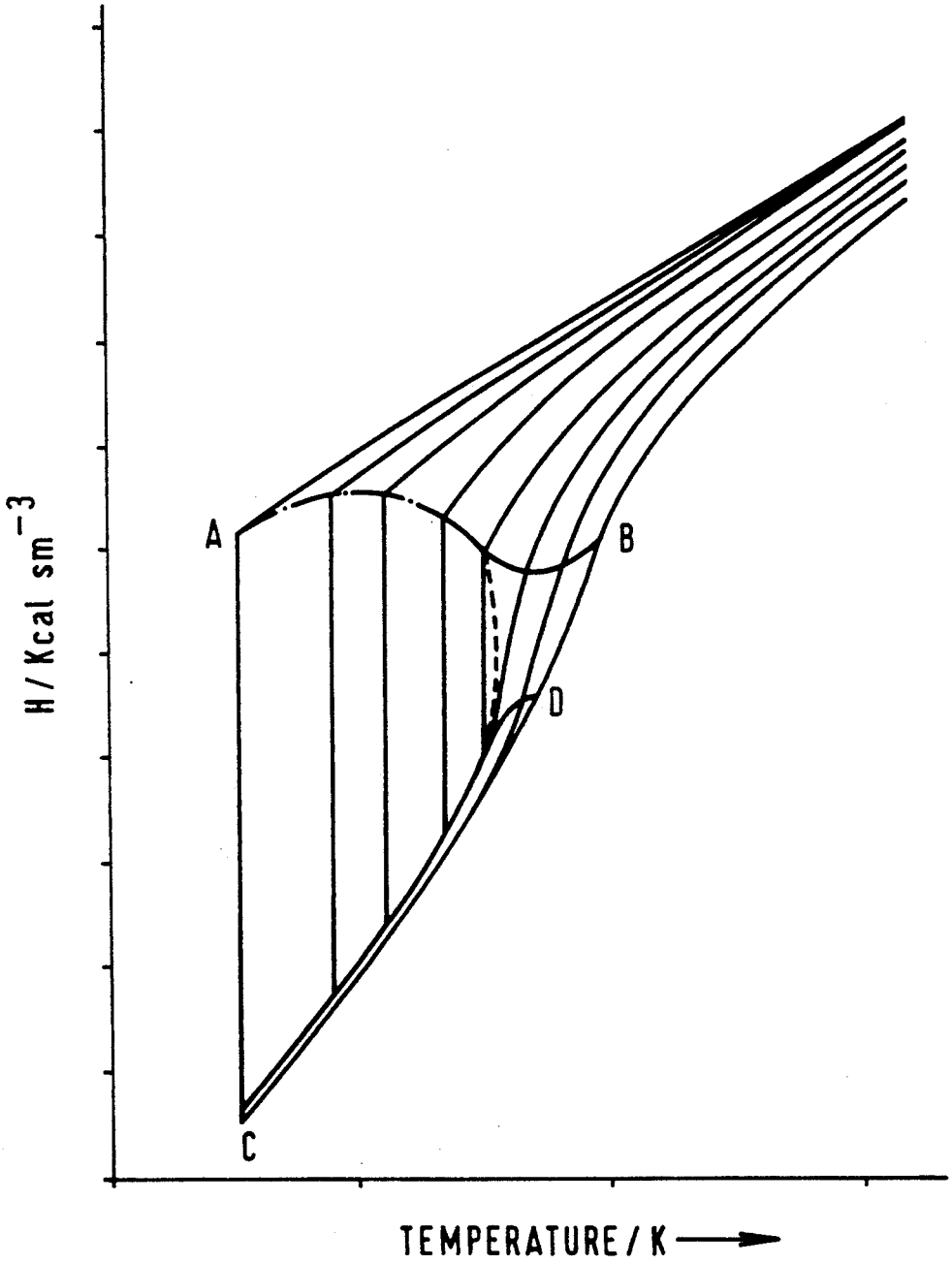
FIG. 1 is a graph showing a series of curves of the specific enthalpy against temperature plotted at different pressures for oxygen.

FIG. 1 of the drawings shows a family of specific enthalpy (enthalpy per standard cubic meter)—temperature curves for nitrogen. At a given pressure, the specific enthalpy progressively falls with decreasing temperature. Each one of the curves has two maxima, one at a higher temperature and one at a lower temperature. The higher temperature maxima of the curves lie on the line AB. The lower temperature maxima lie on the line CD. Nitrogen has a critical pressure of 33.18 bar. At a given pressure below the critical pressure, the two maxima on the specific enthalpy-temperature curve have the same temperature. In other words, the temperature-enthalpy curve is vertical between the two maxima. For a specific enthalpy-temperature curve of oxygen at a pressure below the critical pressure, its maximum lying on the line AB is the point at which gaseous nitrogen starts to liquefy and its maximum lying on the line CD is the point at which liquefaction is complete. At a pressure above the critical pressure, the maximum on the line AB is at a higher temperature than the maximum on the line CD. At above the critical pressure, there is no discrete change of phase from the gas to the liquid, but if the fluid at or below the maximum lying on the line CD is subjected to a reduction in pressure to below the critical pressure, liquid nitrogen will be produced.

A similar family of curves to that shown in FIG. 1 can be drawn for oxygen. At a given pressure, the respective maxima for oxygen occur at lower temperatures than for nitrogen, and the critical pressure of oxygen is higher (50.42 bar). A similar set of curves can also be plotted for air. The respective maxima for air also occur at lower temperatures than for air. Air does not have a single critical pressure as such. There is one temperature in pressure which is the maximum at which a vapor can exist in equilibrium with liquid air, and a slightly different critical point where a liquid can exist in equilibrium with gaseous air. The first of these points, known as the plait point, is at 37.25 bar and 132.4K, and the second, known as the point of contact, is at 132.52K and 37.17 bar. The conventional approach to setting the operating parameters of a process which produces high pressure oxygen by vaporizing liquid oxygen is to arrange for the maxima on the specific enthalpy-temperature curve of the heat exchange stream to be at higher temperatures than the respective maxima on the specific enthalpy-temperature curve of the oxygen stream. This therefore entails using a heat exchange stream of air or nitrogen at a pressure more than twice that of the oxygen stream. The processes described with respect to and shown in FIGS. 2 and 4 enable oxygen to be produced at a pressure in the order of 50 atmospheres absolute without, however, necessitating the use of heat exchange stream pressures in the order of 100 atmospheres absolute.

Figure 2:
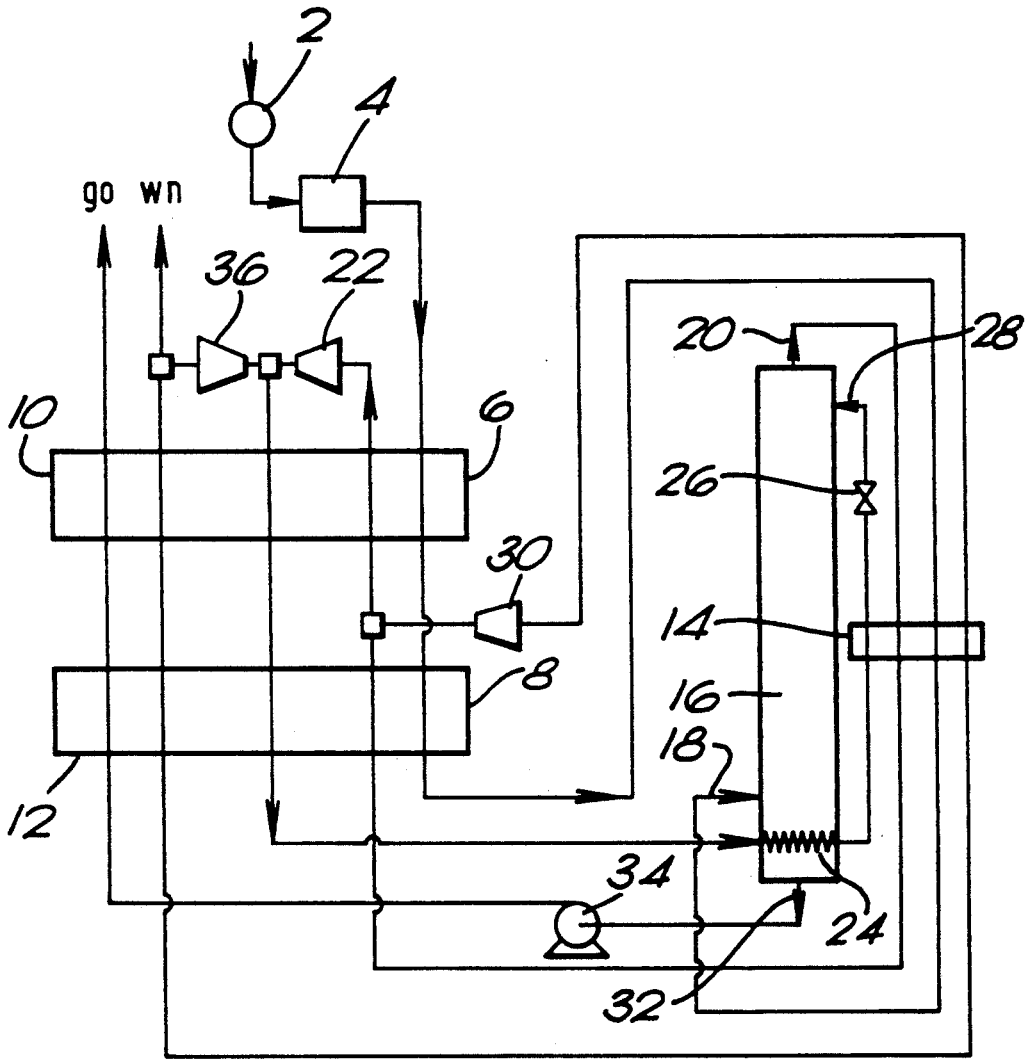
FIG. 2 is a schematic flow diagram of a first air separation apparatus or plant according to the invention.

Referring to FIG. 2 of the drawings, a first compressor 2 receives a stream of air and compresses it to a medium pressure typically less than 8 atmospheres absolute. The compressor 2 has an after cooler (not shown) associated therewith and if it compresses more than one stage, appropriate interstage coolers (not shown). The compressed air stream leaving the compressor 2 passes through a purification apparatus 4 effective to remove low volatility impurities, principally water vapor and carbon dioxide, from the incoming air. The apparatus 4 is of the kind which employs beds of adsorbent (e.g. a molecular sieve such as zeolite) to adsorb the water vapor and carbon dioxide from the incoming air. The beds may be operated out of sequence with one another such that while one or more beds are being used to purify the air the remaining bed or beds are being regenerated, typically by means of a stream of nitrogen. The purified air stream then flows into the warm end 10 of a pair of main heat exchangers 6 and 8 arranged in series with one another. The heat exchangers 6 and 8 are both of the plate-fin type. The air passes through the heat exchanger 6 and then through the heat exchanger 8 and is progressively cooled. It leaves the cold end 12 of the pair of heat exchangers 6 and 8 as a vapor. The cold air stream is then passed through a further heat exchanger 14 and is further reduced in temperature to its dew point by the passage therethrough. The resulting air stream is then introduced into a rectification column 16 through an inlet 18.

The rectification column 16 has disposed therein liquid-vapor contact means, typically in the form of trays or a packing whereby a descending liquid phase is brought into intimate mass-transfer relationship with an ascending vapor phase. The liquid phase thus becomes progressively richer in oxygen as it descends the column 16 and the vapor phase progressively richer in nitrogen as it ascends the column 16. The air is thus separated into oxygen and nitrogen fractions. A stream of nitrogen flows out of the rectification column 16 through an outlet 20 and passes through the heat exchanger 14 from the cold end to the warm end thereof. After leaving the cold end of the heat exchanger 14, the nitrogen stream flows through the main heat exchangers 8 and 6 from their cold end 12 to their warm end 10. The nitrogen is then compressed in a compressor 22 typically to a value in the range of 15 to 20 atmospheres absolute. The compressor 22 has an after cooler (not shown) associated therewith to remove the heat of compression. The resulting compressed nitrogen stream then flows again through the heat exchangers 6 and 8 as a heat exchange stream, this time from their warm end 10 to their cold end 12. The resulting cold nitrogen stream leaves the heat exchanger 8 mainly as a vapor (but containing about 5% as liquid) and is then passed through a reboiler 24 associated with the rectification column 16 in which it boils liquid oxygen to provide a flow of vapor up the column 16. The nitrogen is itself condensed and then flows through the heat exchanger 14 from its warm end to its cold end, thereby being sub-cooled. The resulting sub-cooled liquid nitrogen stream is then passed through a pressure reduction valve 26, thereby being reduced in pressure to the operating pressure of the rectification column 16. The liquid nitrogen is then introduced into the column 16 as reflux through an inlet 28.

In order to provide refrigeration for the process, a part of the nitrogen stream flowing from the cold end 12 of the pair of heat exchangers 6 and 8 to the warm end 10 thereof is taken from a region intermediate the heat exchanger 6 and 8 by an expansion turbine 30 and expanded to a pressure typically in the range of 1 to 1.5 atmospheres absolute. The resulting expanded nitrogen stream then passes through the heat exchanger 14 from its cold end to its warm end and is thereby warmed. The resulting warmed nitrogen stream is further warmed by passage through the heat exchangers 8 and 6 from their cold end 12 to their warm end 10.

A liquid oxygen product is withdrawn from the bottom of the rectification column 16 through an outlet 32 by means of a pump 34. The pump raises the pressure of the liquid oxygen to a value typically in the order of its critical pressure. The resulting pressurized oxygen stream flows through the heat exchangers 8 and 6 from their cold end 12 to their warm end 10. A resulting ambient temperature oxygen product at high pressure, say 50 atmospheres absolute, is thereby produced. At this pressure, the oxygen evaporates in the temperature range 152 to 156K.

In order to provide a relatively close match between the specific enthalpy-temperature curve of the streams being warmed in the main heat exchangers 6 and 8 with that of the streams being cooled, particularly at temperatures below that of the lower temperature maximum on the specific enthalpy-temperature curve of the oxygen stream alone, it is desirable to minimize the flow of relatively high pressure nitrogen through the heat exchanger 6 and 8 from their warm end 10 to their cold end 12. To this end, a part of the expanded nitrogen stream leaving the warm end 10 of the heat exchanger 6 and 8 is withdrawn by a compressor 36 and compressed to the same pressure as the outlet pressure of the compressor 22. The compressor 36 is provided with an after cooler (not shown) to remove the heat of compression from the compressed nitrogen. The stream of compressed nitrogen leaving the compressor 36 is united with the stream leaving the compressor 22. It is this combined stream which provides the heat exchange stream of the invention. When producing oxygen product at a pressure of 50 atmospheres absolute, it is possible to maintain a relatively close conformity between the specific enthalpy-temperature profile of the streams being warmed with that of the streams being cooled in the important temperature range below 150K while maintaining the pressure of the compressed nitrogen below 18 atmospheres absolute.

A computer-simulated example of the operation of the plant shown in FIG. 2 is given in Tables 1 and 2 below.

TABLE 1

EXAMPLES OF OPERATION OF PLANT SHOWN IN FIG. 2

| Stream | Position | Flow Sm3/hr | Temp K | Press atma | Composition, % O2 | N2 | Ar |
|---|---|---|---|---|---|---|---|
| A | a | 10000 | 298 | 6.12 | 20.956 | 78.113 | 0.931 |
| A | b | 10000 | 145 | 6.08 | 20.956 | 78.113 | 0.931 |
| A | c | 10000 | 113 | 6.04 | 20.956 | 78.113 | 0.931 |
| A | d | 10000 | 102 | 6.0 | 20.956 | 78.113 | 0.931 |
| C | a | 12000 | 298 | 17.37 | 0.0001 | 99.9644 | 0.0355 |
| C | b | 12000 | 145 | 17.33 | 0.0001 | 99.9644 | 0.0355 |
| C | c | 12000 | 113 | 17.29 | 0.0001 | 99.9644 | 0.0355 |
| C | d | 12000 | 113 | 17.26 | 0.0001 | 99.9644 | 0.0355 |
| C | e | 12000 | 103 | 17.23 | 0.0001 | 99.9644 | 0.0355 |
| C | f | 12000 | 96.5 | 6.0 | 0.0001 | 99.9644 | 0.0355 |
| B | a | 19800 | 96.5 | 5.84 | 0.0001 | 99.9644 | 0.0355 |
| B | b | 19800 | 109 | 5.80 | 0.0001 | 99.9644 | 0.0355 |
| B | c | 19800 | 137 | 5.76 | 0.0001 | 99.9644 | 0.0355 |
| D | d | 11080 | 137 | 5.76 | 0.0001 | 99.9644 | 0.0355 |
| B | e | 11080 | 280 | 5.72 | 0.0001 | 99.9644 | 0.0355 |
| B | f | 11080 | 298 | 17.37 | 0.0001 | 99.9644 | 0.0355 |
| D | a | 8720 | 137 | 5.76 | 0.0001 | 99.9644 | 0.0355 |
| D | b | 8720 | 94.8 | 1.3 | 0.0001 | 99.9644 | 0.0355 |
| D | c | 8720 | 109 | 1.26 | 0.0001 | 99.9644 | 0.0355 |
| D | d | 8720 | 137 | 1.22 | 0.0001 | 99.9644 | 0.0355 |
| D | e | 8720 | 280 | 1.18 | 0.0001 | 99.9644 | 0.0355 |
| D | f | 7800 | 280 | 1.18 | 0.0001 | 99.9644 | 0.0355 |
| E | a | 920 | 280 | 1.18 | 0.0001 | 99.9644 | 0.0355 |
| E | b | 920 | 298 | 17.37 | 0.0001 | 99.9644 | 0.0355 |
| F | a | 2200 | 111.3 | 6.04 | 95.0 | 0.905 | 4.095 |
| F | b | 2200 | 111.3 | 49.0 | 95.0 | 0.905 | 4.095 |
| F | c | 2200 | 137 | 48.96 | 95.0 | 0.905 | 4.095 |
| F | d | 2200 | 280 | 48.92 | 95.0 | 0.905 | 4.095 |

TABLE 2

DEFINITION OF STREAMS AND POSITIONS OF TABLE 1

| Stream | Position | Definition |
|---|---|---|
| A | | Compressed air stream |
| A | a | At warm end 10 of heat exchangers 6 and 8 |
| A | b | Intermediate heat exchangers 6 and 8 |
| A | c | At cold end 12 of heat exchangers 6 and 8 |
| A | d | At inlet 18 to column 16 |
| B | | Nitrogen stream taken from column 16 |
| B | a | At outlet 20 from column 16 |
| B | b | Leaving heat exchanger 14 |
| B | c | Intermediate warm end of heat exchanger 8 and point at which stream D is taken |
| B | d | Intermediate point at which stream D is taken and cold end of heat exchanger 6 |
| B | e | At warm end 10 of heat exchangers 6 and 8 |
| B | f | Intermediate outlet of compressor 22 and point at which stream C is formed |
| C | | Stream formed by merging streams B and E |
| C | a | At warm end of heat exchangers 6 and 8 |
| C | b | Intermediate heat exchangers 6 and 8 |
| C | c | At cold end of heat exchangers 6 and 8 |
| C | d | At inlet to reboiler 24 |
| C | e | Leaving heat exchanger 14 |
| C | f | At inlet 28 to column 16 |
| D | | Stream taken for expansion from stream B |
| D | a | At inlet to expansion turbine 30 |
| D | b | At outlet from expansion turbine 30 |
| D | c | Leaving heat exchanger 14 |
| D | d | Intermediate heat exchangers 8 and 6 |
| D | e | At warm end 10 of heat exchangers 8 and 6 |
| D | f | Downstream of point from which stream E is taken |
| E | | Stream taken from stream D and merged with stream B to form stream E |
| E | a | At inlet to compressor 36 |
| E | b | At outlet from compressor 36 |
| F | | Oxygen stream taken from column 16 |
| F | a | At outlet 32 of column 16 |
| F | b | At outlet of pump 34 |
| F | c | Intermediate heat exchangers 8 and 6 |
| F | d | At warm end 10 of heat exchangers 8 and 6 |

Figure 3:
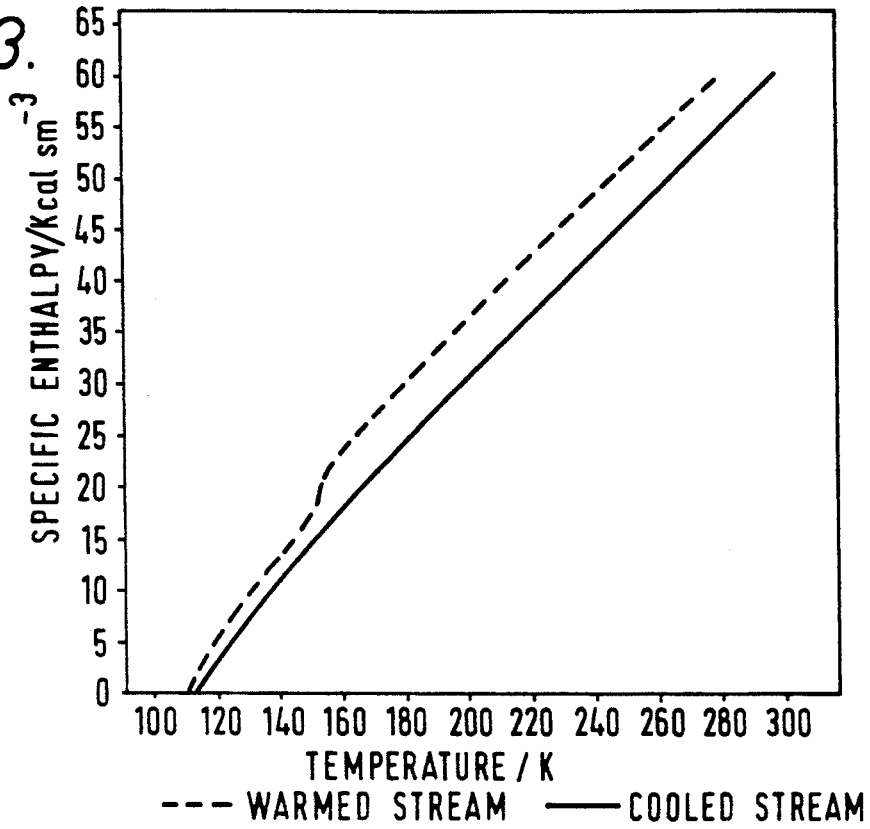
FIG. 3 is a specific enthalpy-temperature graph illustrating operation of the apparatus shown in FIG. 2.

In FIG. 3, there is shown a graph of specific enthalpy plotted against temperature for the streams being warmed and the streams being cooled in the heat exchangers 6 and 8 when the apparatus shown in FIG. 2 is operated in accordance with the example set out in Tables 1 and 2 above.

Figure 4:
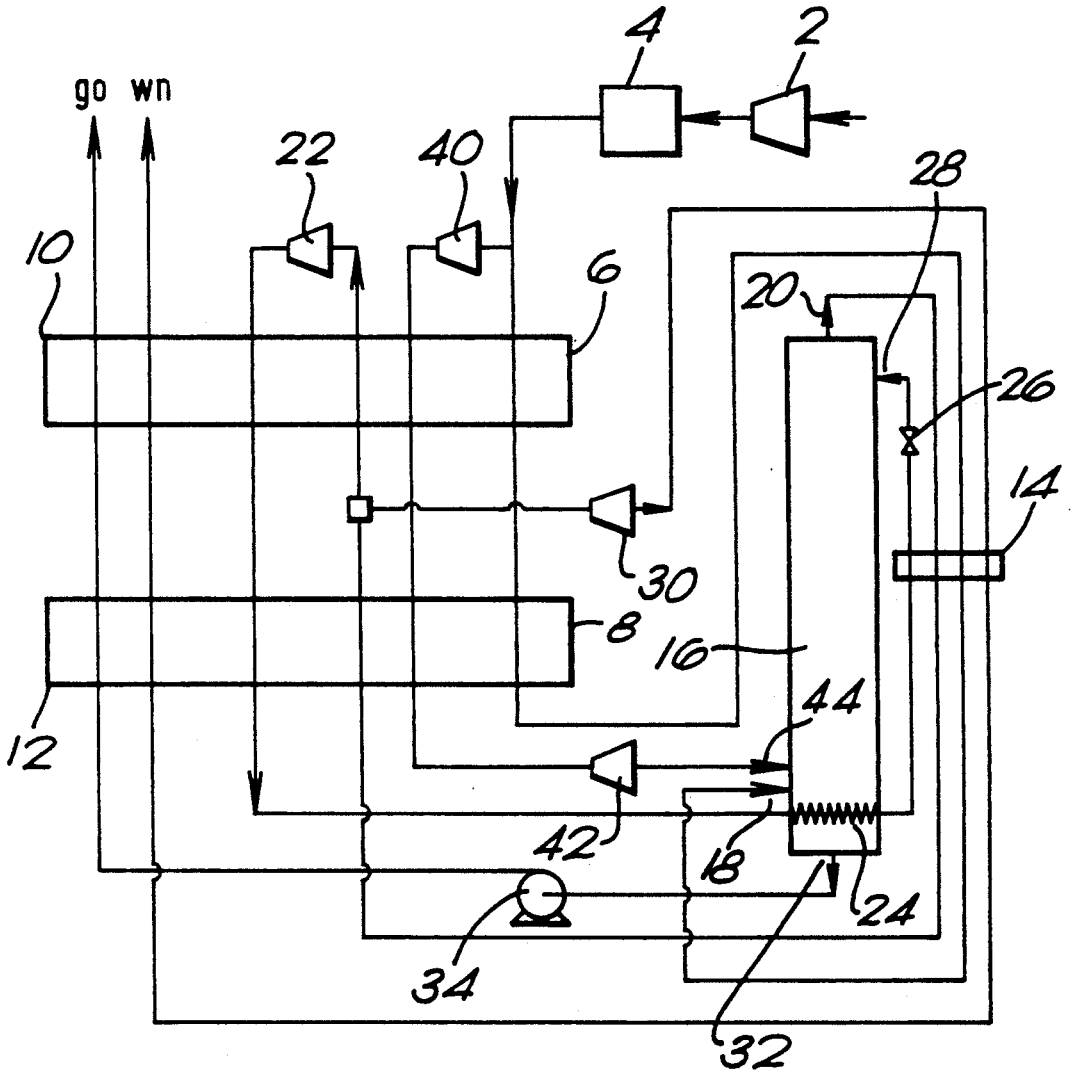
FIG. 4 is a flow diagram of a second apparatus or plant for separating air according to the invention.

The plant shown in FIG. 4 of the drawings is able, in comparison to that shown in FIG. 2, to reduce the flow of high pressure nitrogen through the process, by substituting for a part of it a flow of compressed air at a pressure intermediate the pressure of the main air flow and the compressed nitrogen flow.

Parts of the apparatus shown in FIG. 4 that have like parts in the apparatus shown in FIG. 2 are identified by the same reference numerals as used in FIG. 2 and are not described again herein with reference to FIG. 4.

Comparing the apparatus shown in FIG. 2 with that shown in FIG. 4, there are two main differences. First, none of the expanded nitrogen stream leaving the warm end 10 of the main heat exchanger 6 and 8 is recompressed and recycled to the rectification column 16. Accordingly, there is no compressor 36 in the plant shown in FIG. 4. The second difference is that not all of the purified air stream leaving the purification apparatus 4 flows directly to the warm end 10 of the heat exchangers 6 and 8. Instead, a part of it is further compressed typically to a pressure in the order of 10 atmospheres absolute in a compressor 40. The resulting compressed air stream then flows through the heat exchangers 6 and 8 from their warm end 10 to their cold end 12. This gaseous air stream is then expanded to the operating pressure of the rectification column 16 by an expansion turbine 42. The resulting vapor at its dew point is then introduced into the rectification column 16 through an inlet 44 at a level typically above that of the inlet 18.

A computer-simulated example of the operation of the apparatus shown in FIG. 4 is given in Tables 3 and 4 below.

TABLE 3

EXAMPLE OF OPERATION OF PLANT SHOWN IN FIG. 4

| Stream | Position | Flow Sm3/hr | Temp K | Press atma | Composition, % O2 | N2 | Ar |
|---|---|---|---|---|---|---|---|
| A | a | 6120 | 298 | 6.12 | 20.956 | 78.113 | 0.931 |
| A | b | 6120 | 145 | 6.08 | 20.956 | 78.113 | 0.931 |
| A | c | 6120 | 113 | 6.04 | 20.956 | 78.113 | 0.931 |
| A | d | 6120 | 101 | 6.0 | 20.956 | 78.113 | 0.931 |
| B | a | 3880 | 298 | 10.04 | 20.956 | 78.113 | 0.931 |
| B | b | 3880 | 145 | 10.0 | 20.956 | 78.113 | 0.931 |
| B | c | 3880 | 113 | 9.96 | 20.956 | 78.113 | 0.931 |
| B | d | 3880 | 101 | 6.0 | 20.956 | 78.113 | 0.931 |
| C | f | 12000 | 298 | 17.37 | 0.0001 | 99.9644 | 0.0355 |
| C | g | 12000 | 145 | 17.33 | 0.0001 | 99.9644 | 0.0355 |
| C | h | 12000 | 113 | 17.29 | 0.0001 | 99.9644 | 0.0355 |
| C | i | 12000 | 113 | 17.26 | 0.0001 | 99.9644 | 0.0355 |
| C | j | 12000 | 101 | 17.23 | 0.0001 | 99.9644 | 0.0355 |
| C | k | 12000 | 96.5 | 6.0 | 0.0001 | 99.9644 | 0.0355 |
| C | a | 19800 | 96.5 | 5.84 | 0.0001 | 99.9644 | 0.0355 |
| C | b | 19800 | 110 | 5.80 | 0.0001 | 99.9644 | 0.0355 |
| C | c | 19800 | 137.5 | 5.76 | 0.0001 | 99.9644 | 0.0355 |
| D | a | 7800 | 137.5 | 5.76 | 0.0001 | 99.9644 | 0.0355 |
| C | d | 12000 | 137.5 | 5.76 | 0.0001 | 99.9644 | 0.0355 |
| C | e | 12000 | 280.0 | 5.72 | 0.0001 | 99.9644 | 0.0355 |
| D | b | 7800 | 96.5 | 1.40 | 0.0001 | 99.9644 | 0.0355 |
| D | c | 7800 | 110 | 1.36 | 0.0001 | 99.9644 | 0.0355 |
| D | d | 7800 | 137.5 | 1.32 | 0.0001 | 99.9644 | 0.0355 |
| D | e | 7800 | 280 | 1.28 | 0.0001 | 99.9644 | 0.0355 |
| E | a | 2200 | 111.3 | 6.04 | 95.0 | 0.905 | 4.095 |
| E | b | 2200 | 111.3 | 49.0 | 95.0 | 0.905 | 4.095 |
| E | c | 2200 | 137.5 | 48.96 | 95.0 | 0.905 | 4.095 |
| E | d | 2200 | 280 | 48.92 | 95.0 | 0.905 | 4.095 |

TABLE 4

DEFINITION OF STREAMS AND POSITIONS OF TABLE 3

| Stream | Position | Definition |
|---|---|---|
| A | | Lower pressure air stream |
| A | a | At warm end 10 of heat exchangers 6 and 8 |
| A | b | Intermediate heat exchangers 6 and 8 |
| A | c | At cold end 12 of heat exchangers 6 and 8 |
| A | d | Leaving heat exchanger 14 |
| B | | Higher pressure air stream |
| B | a | At warm end 10 of heat exchangers 6 and 8 |
| B | b | Intermediate heat exchangers 6 and 8 |
| B | c | At cold end 12 of heat exchangers 6 and 8 |
| B | d | At outlet of turbine 42 |
| C | | Nitrogen stream taken from column 16 |
| C | a | At outlet 20 of column 16 |
| C | b | Leaving heat exchanger 14 |
| C | c | Intermediate warm end of heat exchanger 8 and point from where stream D is taken |
| C | d | Intermediate point from where stream D is taken and cold end of heat exchanger 6. |
| C | e | At warm end of heat exchangers 6 and 8 |
| C | f | At outlet of compressor 22 |
| C | g | Intermediate heat exchangers 6 and 8 |
| C | h | At inlet to reboiler 24 |
| C | i | At outlet from reboiler 24 |
| C | j | Leaving heat exchanger 14 |
| C | k | At inlet 28 to column 16 |
| D | | Nitrogen stream taken from stream C for expansion in turbine 30 |
| D | a | At inlet to turbine 30 |
| D | b | At outlet from turbine 30 |
| D | c | Leaving heat exchanger 14 |
| D | d | Intermediate heat exchangers 8 and 6 |
| D | e | At warm end 12 of heat exchangers 8 and 6 |
| E | | Oxygen stream taken from column 16 |
| E | a | At outlet 32 of column 16 |
| E | b | At outlet 34 of pump 34 |
| E | c | Intermediate heat exchangers 8 and 6 |
| E | d | At warm end 10 of heat exchangers 8 and 6 |

Figure 5:
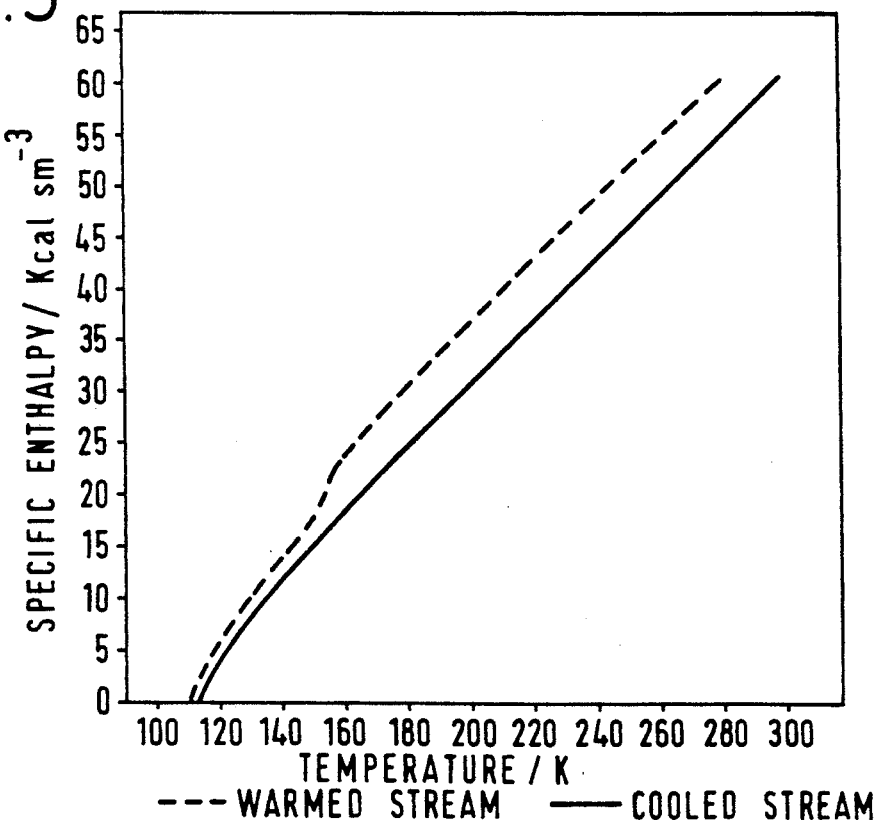
FIG. 5 is a graph of specific enthalpy against temperature illustrating the operation of the apparatus shown in FIG. 4.

In FIG. 5 there are shown the specific enthalpy-temperature curves of respectively the streams being warmed and the streams being cooled in the heat exchangers 6 and 8 during operation of the plant shown in FIG. 4 in accordance with the example set out in Tables 3 and 4 above. There is a similar relationship between the streams being warmed and the streams being cooled in this operation to the operation of the plant shown in FIG. 2 as illustrated in FIG. 3.

I claim:

1. A method of separating air including: compressing and purifying the air; cooling the air within a main heat exchanger to reduce its temperature to a level suitable for its separation by rectification; separating the air into oxygen and nitrogen fractions by introducing the air into a rectification column comprising a single stage; taking a stream of liquid oxygen from the oxygen fraction and a stream of nitrogen vapor from the nitrogen fraction; warming the stream of nitrogen vapor within the main heat exchanger in countercurrent heat exchange with the air being cooled; dividing the stream of the nitrogen vapor into first and second subsidiary streams, withdrawing the first subsidiary stream from the main heat exchanger intermediate its cold and warm ends, and withdrawing the second subsidiary stream from the warm end of the main heat exchanger; expanding the first subsidiary stream with the performance of external work and countercurrently heat exchanging it within the main heat exchanger with the air passing to the rectification column; compressing the second subsidiary stream and then, pressurizing the liquid oxygen stream and raising its temperature by countercurrent heat exchange with the second subsidiary stream and the air being cooled within the main heat exchanger; condensing the second subsidiary stream to form a liquid nitrogen stream; sub-cooling the liquid nitrogen stream in a heat exchanger by heat exchange with at least part of the air, after compression, purification and cooling of the air; providing cooling for the heat exchanger with the first subsidiary stream; and introducing the liquid nitrogen stream, after having been subcooled, into the rectification column as reflux.

2. The method as claimed in claim 1, in which the relative pressures to which said stream of the liquid oxygen and said second subsidiary stream are raised are such that the lower temperature maximum on the specific enthalpy-temperature curve of said second subsidiary stream is at a temperature not greater than that of the lower temperature maximum on the specific enthalpy-temperature curve of said stream of the liquid oxygen.

3. The method as claimed in claim 1 or claim 2, in which said second subsidiary stream leaves a cold end of the main heat exchanger with a specific enthalpy and at a temperature that lies below the lower temperature maximum on the specific enthalpy-temperature curve of said second subsidiary stream.

4. The method as claimed in claim 1, in which the reflux and re-boil for the rectification column are provided by a heat pump cycle wherein: the stream of the nitrogen vapor is withdrawn from the top of the rectification column; after the second subsidiary stream is compressed, it is returned through the main heat exchanger from the warm end to the cold end thereof, the second subsidiary stream is condensed against vaporizing the liquid oxygen within the rectification column to thereby provide re-boil for the rectification column; and the liquid nitrogen stream is passed through a valve to reduce its pressure prior to its being introduced into the rectification column as the reflux.

5. The method as claimed in claim 4, wherein: the air is divided into first and second subsidiary air streams upstream of the warm end of the main heat exchanger; the first subsidiary air stream comprises the at least part of the air that is heat exchanged with the liquid nitrogen stream to subcool the liquid nitrogen stream; the second subsidiary air stream is further compressed, then passed through the main heat exchanger and expanded in a turbine; after the second subsidiary air stream is expanded, it is introduced into the rectification column as a liquid.

6. An apparatus for separating air comprising: a first compressor for compressing the air; purification means for purifying the air; a main heat exchanger having a first pass in communication with the purification means for reducing the temperature of the air to a temperature suitable for its separation by rectification; a rectification column comprising a single stage connected to the main heat exchanger for separating the air into oxygen and nitrogen fractions and having an inlet in communication with the first pass of the main heat exchanger for receiving the air after having been cooled and a first outlet for discharging a liquid oxygen stream; a pump in communication with said first outlet of the rectification column and a second pass of the main heat exchanger in heat exchange relationship with the first pass thereof so as to be operable to pump the liquid oxygen stream through the second pass of the main heat exchanger in countercurrent heat exchange with the air passing through the first pass of the main heat exchanger; the rectification column also having a second outlet for discharging a stream of a nitrogen vapor; means associated with the main heat exchanger and in communication with the second outlet of the rectification column for dividing the stream of the nitrogen vapor into first and second subsidiary streams so that the first subsidiary stream passes from the main heat exchanger intermediate its cold and warm ends and the second subsidiary stream passes from the warm end of the main heat exchanger; an expansion turbine in communication with the dividing means so that the first subsidiary stream is expanded after having passed from the main heat exchanger; a second compressor connected to the dividing means for compressing the second subsidiary stream after it has passed from the warm end of the main heat exchanger; the compresser also being connected to a third pass of the main heat exchanger so that after the compression of the first subsidiary stream, it passes through the main heat exchanger countercurrently to the liquid oxygen stream; means connected to the third pass of the main heat exchanger for condensing the second subsidiary stream after passage through the main heat exchanger thereby to form a liquid nitrogen stream; and a further heat exchanger for sub-cooling the liquid nitrogen stream; said further heat exchanger in communication with said rectification column so that the liquid nitrogen stream after sub-cooling passes into the rectification column as reflux; and said further heat exchanger having a passage in communication, at opposite ends thereof with the expansion tubine and a forth pass of the main heat exchanger so that the second first stream passes through the further heat exchanger and then in countercurrent heat exchange with the compressed air stream within the main heat exchanger.

7. The apparatus as claimed in claim 6, additionally including a further compressor connected between the first pass and the purification means and to a fifth pass of the main heat exchanger, at the warm end thereof, so that a subsidiary air stream after purification is compressed and then is condensed within the main heat exchanger; the rectification column in communication with the fifth pass of the main heat exchanger, at the cold end thereof, so that the condensed subsidiary air stream is introduced into the rectification column.

* * * * *